US005113195A

United States Patent [19]

Sakurai et al.

[11] Patent Number: 5,113,195

[45] Date of Patent: May 12, 1992

[54] GLASS WINDOW ANTENNA FOR USE IN A MOTOR VEHICLE

[75] Inventors: Kaoru Sakurai, Kawasaki; Harunori Murakami, Machida; Masaru Maeda, Kawasaki; Hiroshi Iijima, Yokohama; Shouhei Ohara, Kawasaki, all of Japan

[73] Assignee: Nippon Sheet Glass Co., Ltd., Osaka, Japan

[21] Appl. No.: 427,587

[22] Filed: Oct. 26, 1989

[30] Foreign Application Priority Data

Oct. 31, 1988 [JP] Japan ..... 63-142518
Nov. 30, 1988 [JP] Japan ..... 63-155642

[51] Int. Cl.[5] ..... H01Q 1/32
[52] U.S. Cl. ..... 343/704; 343/713
[58] Field of Search ..... 343/704, 713

[56] References Cited

U.S. PATENT DOCUMENTS 3,928,748 12/1974 Sauer ..... 343/704
4,063,247 12/1977 Sakurai et al. ..... 343/704
4,422,077 12/1983 Kropielnicki ..... 343/704
4,439,771 3/1984 Kume et al. ..... 343/704

FOREIGN PATENT DOCUMENTS 61-30102 2/1986 Japan .
61-73403 4/1986 Japan .
61-203702 9/1986 Japan .
61-175010 10/1986 Japan .
62-201508 12/1987 Japan .
63-26925 11/1988 Japan .

*Primary Examiner*—Michael C. Wimer
*Attorney, Agent, or Firm*—Woodcock Washburn Kurtz Mackiewicz & Norris

[57] ABSTRACT

A glass window antenna for use in a motor vehicle provides satisfactory antenna characteristics while making best use of the space of a glass window with a heating conductor as the main antenna element which is heated by a pair of power supply lines through choke coils. In a preferred embodiment, a capacitor is connected across the power supply lines at a position between the choke coils and the heating conductor to minimize the loss or leakage of radio signals from the heating conductor through the choke coils. A symmetrical pair of wires coupled with each other is formed on the glass window and connected to ends of the heating conductor to improve a radio wave reception gain.

18 Claims, 14 Drawing Sheets

GLASS WINDOW ANTENNA FOR USE IN A MOTOR VEHICLE

BACKGROUND OF THE INVENTION

The present invention relates to window glass antennas for motor vehicles and, more particularly to an antenna arrangement in which a defogging heater conductor formed on a window glass of a motor vehicle serves as an antenna for receiving radio signals.

An antenna arrangement of this kind is known in the art. In order to assure that a sufficient amount of radio signals received in such a heating conductor be available for a radio receiver or tuner, a leakage of the received signals to a direct current (DC) heater power supply or ground must be minimized. To this end, it was proposed to connect choke coils in the heating power supply lines so that the heating conductor will be floated or isolated from the heater power supply in high frequencies while allowing the heating power of DC current to pass through the choke coils. If the heating conductor antenna covers an FM broadcasting band only, choke coils having a relatively small inductance will suffice. However, such small coils will considerably decrease their impedance of radio signal leakage for an AM broadcasting band, thus reducing available antenna power in an AM band. On the other hand, if a large inductance of choke coils is employed, this will give a satisfactory antenna gain for an AM band but render a poor antenna reception sensitivity to an FM band because of an increased parasitic capacitance in such high inductance choke coils. In this view, the prior art has adopted an arrangement in which choke coils associated with a defogging heating conductor is made to have a relatively large inductance so that the heating conductor will serve only as an AM antenna. Separate antenna conductor elements are formed on the same window as that with the heating conductor to provide an FM antenna.

FIG. 1 shows an example of the prior art window glass antenna of this type. The antenna is arranged such that a large number of heater wires or strip conductors 2 constituting a defogging heater conductor 10 and serving as an AM antenna are formed in a defogging area of a rear glass window 1. The heater wires are subdivided into upper and lower wire groups which are powered from power supply buses 3 and 4 connected to first ends of the upper and lower wire groups, respectively. A connecting bus 5 is disposed along and commonly connects second or remote ends of the upper and lower wire groups to complete a heating current path. Since the heater wires 2 are used as an AM broadcast band reception antenna, a feeder cable 13 such as a coaxial cable is connected to a feeding point 12 provided in the connecting bus 5. The feeder cable 13 carries the received signal to an AM radio tuner mounted in the motor vehicle through a DC cut capacitor 14.

A separate FM antenna 6 is formed in a blank portion of the window 1 above the heater wires 2. It comprises a main antenna element **6*a* in the form of two parallel wires connected to each other in a substantial U shape, an auxiliary antenna element 6*b* disposed above and connected to the upper wire of the main antenna element 6*a*, another auxiliary antenna element 6*c* connected to the lower wire of the main antenna element 6*a* and facing the heater wires 2, and a folded element 6*d* bent back from the upper wire of the main antenna element and having a portion adjacent to the auxiliary antenna 6*b*. A feeding point 7 is formed on the folded portion 6*d* and connected to a feeder cable 8 for supplying an FM reception signal to an FM radio tuner through a DC cut capacitor 9**.

A main DC power supply feeds a heating current to the power supply buses 3 and 4 through choke coils **16*a* and 16*b* magnetically coupled to each other. The choke coil 16*a* connected to a main power +B is negatively coupled to the choke coil 16*b* connected to a ground so that magnetic fluxes generated by the respective heating currents cancel each other within a core. Therefore, the core having a small volume can be operated in a nonsaturated state. A decoupling capacitor 20** is connected between a ground and a line connected to the main power +B to prevent power source noise from being superposed on the reception signal.

FIG. 2 illustrates another example of the prior art window glass antenna arrangement. In FIGS. 1 and 2, like references refer to like parts. In this example of FIG. 2, two FM antennas 36 and 38 are provided on spaces S1 and S2 in the window 1 above and below the heating conductor 10 as an AM antenna, respectively. The top FM antenna 36 includes, a coupling element 37 along the uppermost heating wire 2 for coupling with the heater conductor 10, and a feeding pad 7 connected to a feeder cable 35 for carrying AM and FM signals to an AM/FM tuner. The bottom FM antenna 38 also includes a coupling element 39 along the lowermost heating wire for coupling with signals from the heater conductor 10 and a feeding pad 40 connected to another feeder cable 41 for supplying the AM/FM tuner with AM and FM signals received in the heater conductor 10 and the bottom FM antenna conductor 38.

As noted from the foregoing, the prior art requires a separate antenna element or elements for receiving an FM band signals in addition to the heater conductor because the heater conductor only serves as an AM antenna. Such separate antenna element thus requires a relatively wide space for its mounting, as wide as about 120 to 150 mm above and/or below the heater conductor. Therefore, the prior art antenna arrangement is applicable only to a vehicle window glass having a large space; in small-sized cars such as two-box car, the rear window glass is limited in size, and further limited when it is mounted relatively up-right in the vehicle so that there is only a small top or bottom margin left in available for mounting an FM antenna conductor, once the heating conductor is formed on such small vehicle window.

Even in a motor vehicle having a relatively large window glass area and hence a large blank area, a TV broadcast reception antenna, an automobile telephone antenna, and the like are often formed in the blank portion. In this case, no further sufficient area is assured an FM antenna. Therefore, even if the glass window area is large, a glass antenna capable of receiving FM programs cannot often be formed.

SUMMARY OF THE INVENTION

An object of the present invention is to provide a glass window antenna for use in a motor vehicle capable of making best use of the space or surface of a vehicle window (e.g., rear window) for defogging and antenna purposes.

A specific object of the invention is to provide a glass window antenna for use in a motor vehicle in which a heating conductor formed on a glass window can serve as an antenna element with a satisfactory reception sensitivity to radio waves covering a relatively-wide range of radio frequencies, e.g., both AM and FM broadcasting bands.

Another object of the invention is to provide a glass window antenna for use in a motor vehicle capable of minimizing leakage of received radio signals from antenna elements (e.g., heating conductor) formed on a glass window to thereby maximize an available antenna gain for a radio receiver.

Another object of the invention is to provide a glass window antenna for use in a motor vehicle capable of providing desirable antenna characteristics without requiring a separate and FM dedicated antenna element which is a separate component from a heating conductor formed on a glass window and which consumes a considerable space of the glass window.

In accordance with an aspect of the present invention, there is provided a glass window antenna for use in a motor vehicle which comprises a heating conductor formed on a glass window, choke coils each connected in a different one of a pair of power supply lines supplying a heating current to the heating conductor, and a capacitive circuit connected to the pair of power supply lines at a position between the choke coils and the heating conductor.

With this arrangement, improved antenna characteristics (e.g. antenna gain for an FM band) can be attained. It is expected that leakage of the signals generated in the heating conductor in response to radio waves is minimized because of the function of the capacitive circuit connected across the heating power supply lines. Therefore, the available radio signals for a radio receiver will be increased. Stated in another way, the combination of the capacitive circuit and the choke coils serves as an optimal impedance element which effectively prevents the radio signals received in the heating conductor from passing or leaking through the choke coils while allowing passing the heating current to the heating conductor through the choke coils and the power supply lines.

Moreover, the capacitive circuit serves to vary or adjust the effective length of the antenna because it is connected across the pair of power supply lines that are connected to the heating conductor receiving radio waves.

The choke coils may be magnetically coupled to each other in a nonsaturated state.

Each choke coil may have a relatively large inductance.

The power supply lines may carry a direct current to heat the heating conductor.

For example, the choke coils have a relatively high impedance for a first band of frequencies (e.g., an AM broadcasting band) and have a relatively low impedance for a second band of frequencies (e.g., an FM broadcasting band) which is higher than the first band by at least one order of magnitude.

There may be further provided a feeder connected to the heating conductor for carrying signals (e.g., covering both AM and FM bands) received in the heating conductor as being available for a radio receiver such as AM and FM tuners.

The heating conductor may be arranged in a pattern of strip conductors or wire over a surface of the glass window.

In accordance with another aspect of the invention, there is provided a glass window antenna for use in a motor vehicle comprising a heating conductor formed on a glass window, a pair of antenna elements arranged on the glass window in such a manner that one of the pair of antenna elements bears a substantial symmetry with the other of the pair of antenna element in which a first end of the heating conductor is connected to a first end of the one antenna element while a second end of the heating conductor is connected to a first end of the other antenna element and in which respective second ends of the pair of the antenna elements faces each other.

Measurement tests of an antenna arrangement of this type have indicated that it provides improved antenna characteristics, in particular, reception sensitivity to radio waves in an FM band. It is thought that the pair of antenna elements function to modify a condition such as electromagnetic field around the heater conductor so as to increase an available radio power therefrom.

Preferably, an additional antenna element may be formed on the glass window between the pair of antenna elements. According to tests, with the additional antenna element, the antenna gain is made flat over an FM band. The additional antenna element may be regarded as a coupling means for coupling the pair of antenna elements with each other with respect to signals generated or carried therein.

The additional antenna element may be in alignment with and spaced from the pair of antenna elements.

An antenna feed point may be provided in the heating conductor for gathering radio signals received in the heating conductor and the pair of antenna elements.

In accordance with a combined aspect of the invention, there is provided a glass window antenna for use in a motor vehicle which comprises a heating conductor formed on a glass window, choke coils, a pair of power supply lines for connecting the choke coils to the heating conductor to supply a heating current to the heating conductor, a pair of antenna elements formed on the glass window, connected to the heating conductor and having a substantially symmetrical relationship with each other with respect to the heating conductor, and a capacitive circuit connected across the power supply lines.

The capacitive circuit may comprise a capacitor having a capacitance preferably between 5 pico and 0.5 micro farads, and most preferably between 30 and 200 pico farads.

BRIEF DESCRIPTION OF THE DRAWINGS

The above and other objects, features and advantages of the invention will be more apparent from the following description taken in conjunction with the drawings in which.

DETAILED DESCRIPTION OF THE INVENTION

Figure 3:
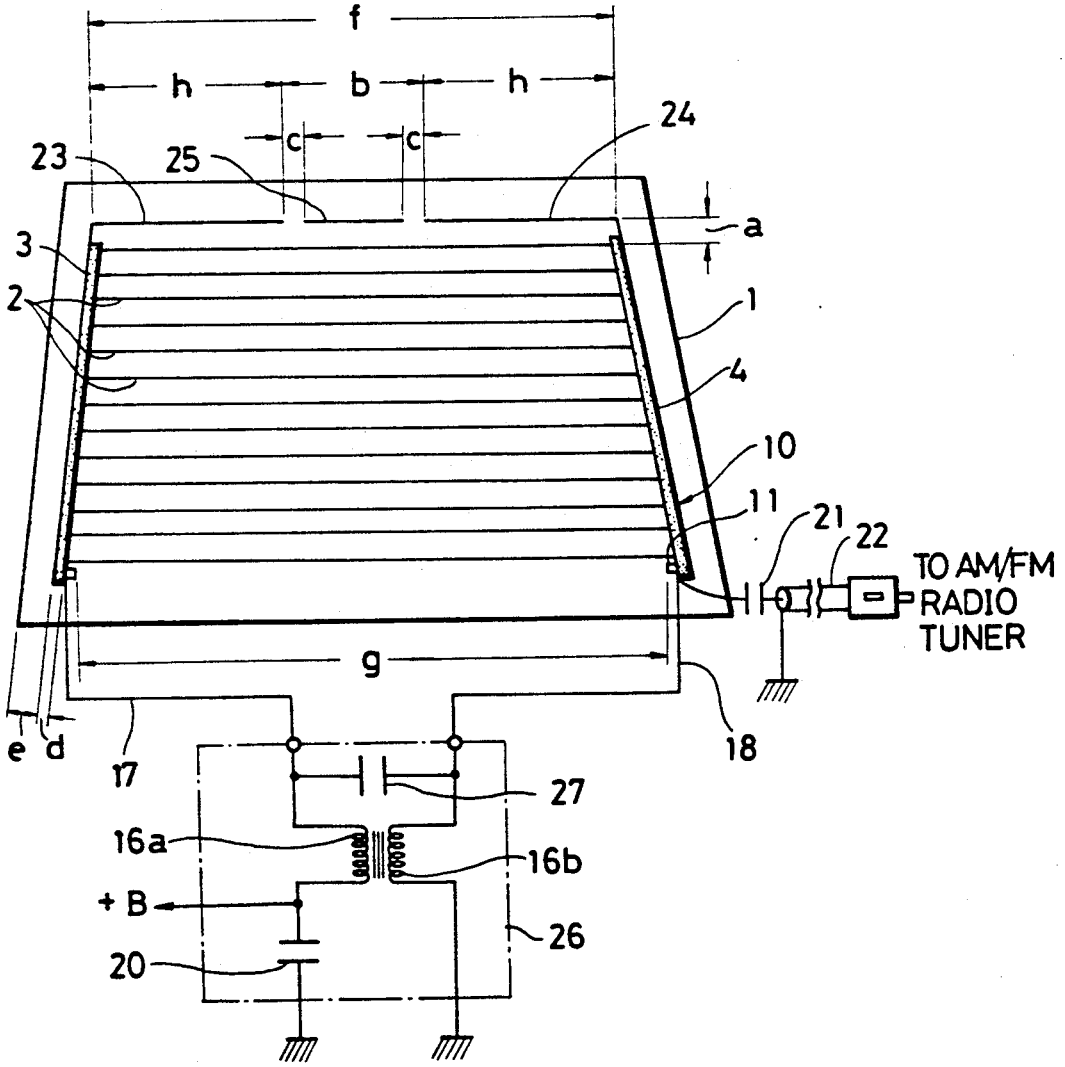
FIG. 3 shows a vehicle glass window antenna together with associated electric circuitry in accordance with an embodiment of the invention.

Referring first to FIG. 3, there is shown a front view of a rear glass window for a motor vehicle mounting a radio receiving antenna function in conjunction with associated circuitry shown in a schematic diagram in accordance with an embodiment of the invention.

A heating conductor 10 is arranged in a defogging area of a rear glass window 1. When a heating current is supplied to the heating conductor 10, it is heated to defog the glass surface. The heating conductor 10 has power supply buses 3 and 4 extending along opposite side edges of the rear glass window 1, and thirteen heater wires 2 spaced at equal intervals of a=31 mm from one another and connected between the power supply buses 3 and 4. In accordance with the invention a pair of antenna elements 23 and 24 is formed on a top margin of the glass window 1 and bears a symmetrical relationship with each other with respect to a central axis of the heating conductor 10. The left-hand antenna element 23 has a left end connected to the upper end of the power supply bus 3 of the heating conductor 10 while the right-hand antenna element 24 has a right end connected to the upper end of the power supply bus 4 of the heating conductor 10. These antenna elements 23, 24 are parallel to the uppermost heater wire 2 and spaced therefrom by an interval of 31 mm. The other or free ends of the antenna elements 23, 24 are spaced apart from each other by a distance b=350 mm to oppose each other near a central axis of the rear glass window 1. An auxiliary antenna wire 25 is formed between the other ends of the antenna elements 23, 24, spaced therefrom by a distance c=5 mm and in alignment with the wires 23, 24 so that the antenna wires 23-25 appear to be a single straight line. The antenna elements having free ends will change a state of a radio wave propagating on the heating conductor 10. Therefore, an appropriate choice of the dimensions of the antenna elements will optimize antenna reception sensitivity of the heating conductor 10 to an FM broadcasting band.

Sizes d to g of the respective parts in FIG. 3 are given as follows: d=10 mm; e=28 mm; f=895 mm; and g=1,030 mm.

A feed point or pad 11 is provided in the heating conductor 10, here, at the bottom of the right-hand power supply bus 4. The feed pad 11 gathers radio signals covering at least AM and FM broadcasting bands, as received in the heating conductor 10 and the symmetrical antenna elements 23 to 25. A feeder cable 22 is in the form of a coaxial cable is connected to the feeder pad 11 via a capacitor 21 to carry the signals to radio receiving circuitry such as AM and FM tuners (not shown).

Choke coils 16*a* and 16*b* are respectively inserted into power supply lines 17 and 18. The choke coils are magnetically coupled with each other in a nonsaturated state.

The opposite end of the choke coil 16*a* from the heater conductor 10 is connected to a direct current (DC) power supply at its positive terminal indicated by +B in FIG. 3 and it is also connected to a ground via a capacitor 20 for a surge or noise absorber while the opposite end of the choke coil 16 from the heater conductor 10 is grounded.

Figure 1:
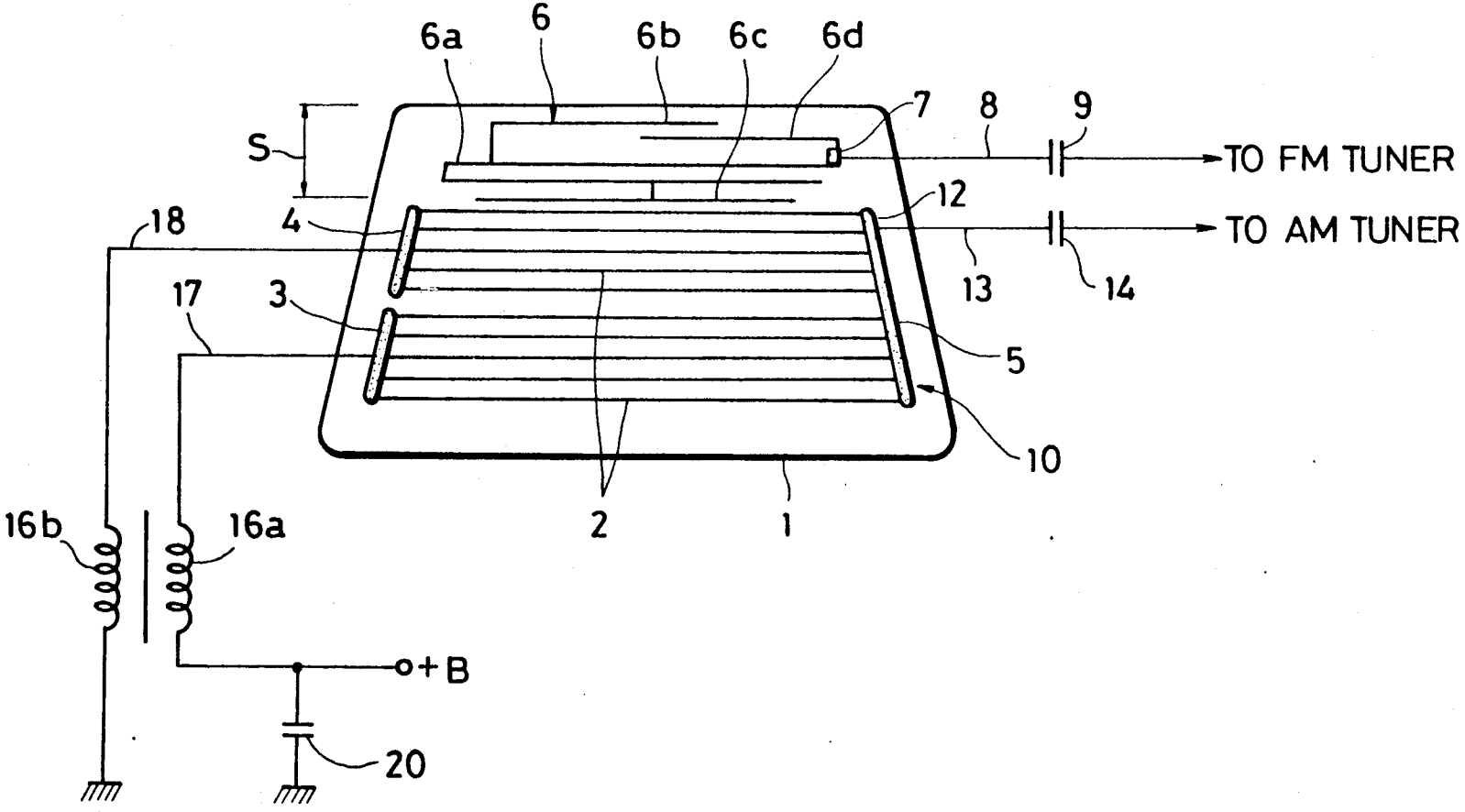
FIG. 1 (PRIOR ART)
FIG. 1 shows a prior art vehicle glass window antenna together with associated electric circuitry.
Figure 2:
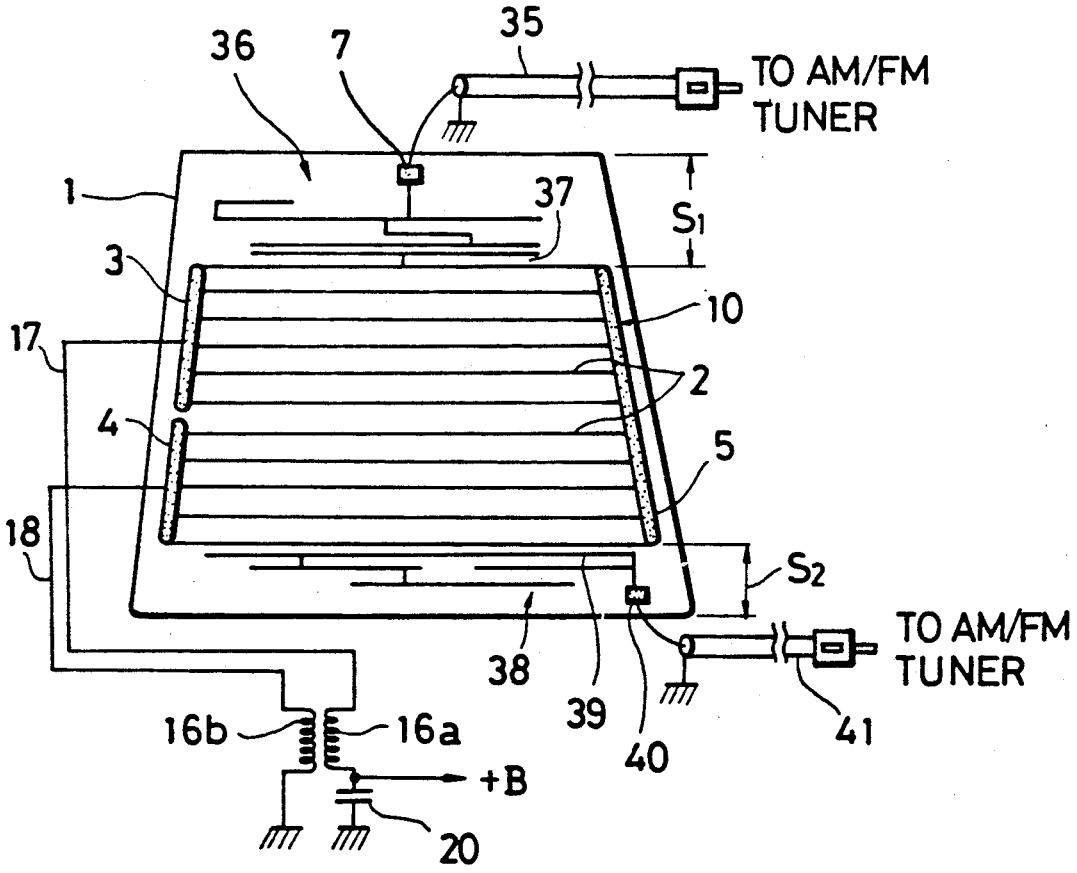
FIG. 2 (PRIOR ART)
FIG. 2 shows another prior art vehicle glass window antenna with associated electric circuitry.

The inductance of the choke coils 16*a* and 16*b* are preferably large to improve reception sensitivity to an AM broadcast band. However, this also makes large the capacitances in the choke coils 16*a* and 16*b* so that for higher frequencies such as an FM broadcasting band, an impedance across each of the choke coil is decreased, thereby degrading antenna reception sensitivity. For example, with a trodial core type choke coil having an inductance of 980 mH as each choke coil 16*a*, 16*b*, a test of the antenna reception sensitivity to an FM broadcasting band resulted in a low gain as indicated by a broken curve A in a reception sensitivity graph of FIG. 2.

In this view and in accordance with the invention, there is provided a capacitor 27 connected across the power supply lines 17 and 18 between the choke coils 16*a* and 16*b*, and the heating conductor 10, as indicated within a block 26 in FIG. 3.

The capacitor 27 serves to compensate for a change in the effective length of the heating conductor 10 resulting from the connection of the heating power supply lines 17 and 18 thereto. In addition, the capacitor 27 will compensate for an increase in the leakage of radio signals of higher frequencies such as FM broadcasting band through the choke coils 16*a* and 16*b* from the heating conductor 10 due to the capacitance in the choke coils which causes the impedance across each choke coil 16*a*, 16*b* to be decreased for higher frequencies. Therefore, with the capacitor 27, the arrangement of FIG. 3 can provide an increased antenna gain for a band of higher frequencies such as FM band covering at least 76 to 90 MHz while maintaining a satisfactory antenna gain for another band of relatively low radio frequencies such as an AM broadcasting band covering at least 600 to 1600 KHz.

Figure 4:
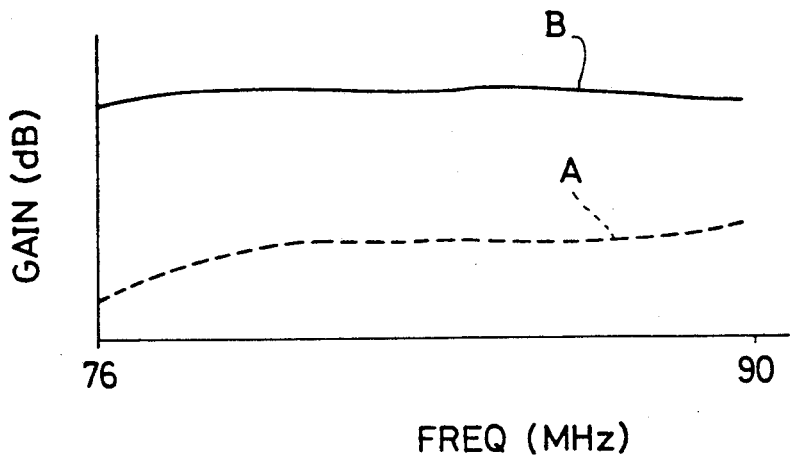
FIG. 4 is a graphic presentation of antenna reception sensitivity to an FM band for the embodiment of FIG. 3 as compared with the sensitivity of an antenna arrangement without the capacitor 27 in FIG. 3.

A test of reception sensitivity of the antenna arrangement with the capacitor 27 has indicated a greatly improved antenna gain for the entire range of the FM broadcasting band as shown in a solid curve B in FIG. 4 as compared with the curve A measured without the capacitor 27.

Figure 5:
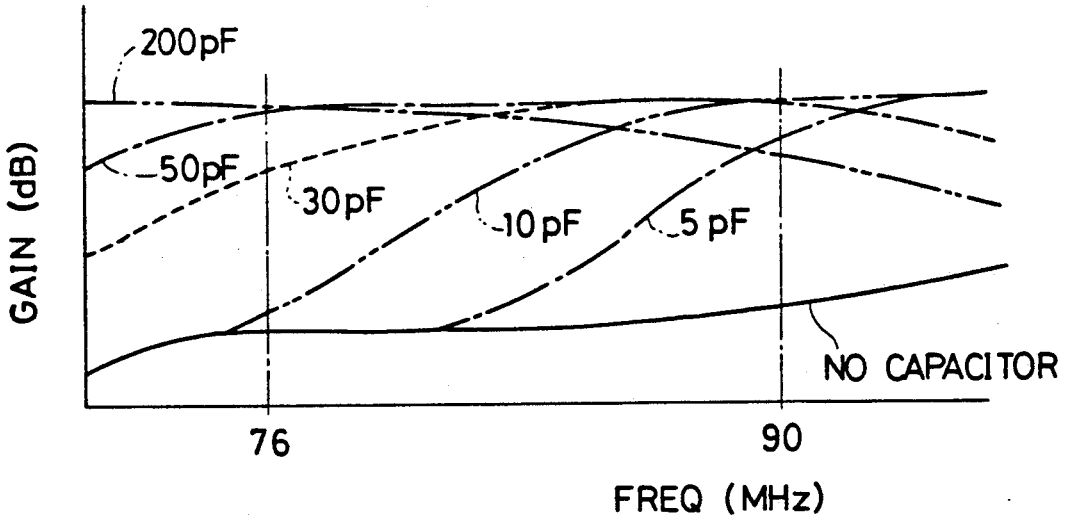
FIG. 5 is a graphic presentation of FM radio reception sensitivity for various values of the capacitor 27 in FIG. 3.

FIG. 5 shows test results of reception sensitivity to the FM band using several different capacitive values of the capacitor 27. As noted, the peak of the antenna gain shifts to lower frequencies as the capacitance increases.

The optimal capacitance of the capacitor 27 depends considerably on the electrical characteristics of the choke coils which is a function of their type, form, size and so an. According to tests, however, the capacitor with a capacitance between approximately 5 pico farads to 0.1 micro farads served to improve the reception sensitivity to an FM band of 76 to 90 MHz. In particular, a capacitance between 30 to 200 pico farads yielded most desirable results.

Figure 6:
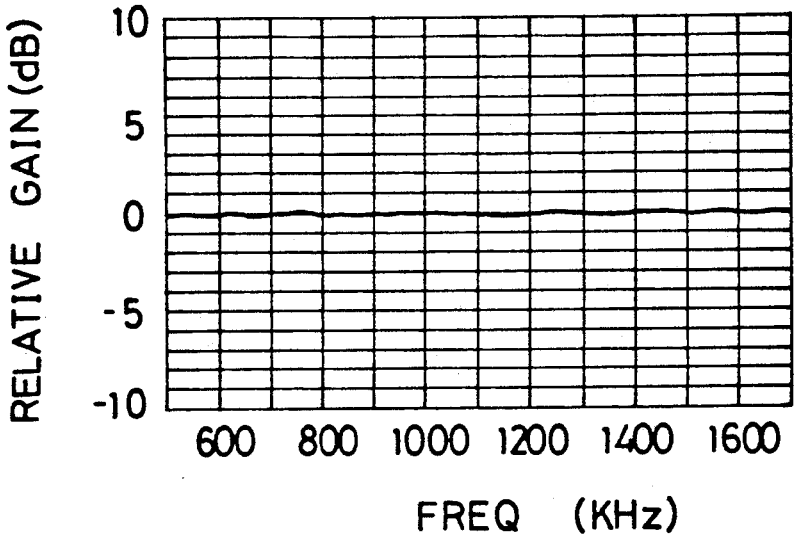
FIG. 6 is a graphic presentation of relative antenna reception sensitivity to an AM band with the embodiment of FIG. 3 as compared with a reference of the antenna arrangement without the capacitor 27 in FIG. 3.

The addition of the capacitor 27 maintains reception sensitivity to an AM broadcasting band of 600 to 1600 KHz as demonstrated in FIG. 6 which shows a relative reception sensitivity with the capacitor 27 as compared with that of no capacitor 27, normalized by zero decibel in FIG. 6.

As described earlier, the symmetrical antenna elements 23 to 25 is expected to improve the radio signal condition in the heating conductor 10.

According to tests, the antenna elements 23 to 25 did improved antenna characteristics for an FM broadcasting band.

Figure 7:
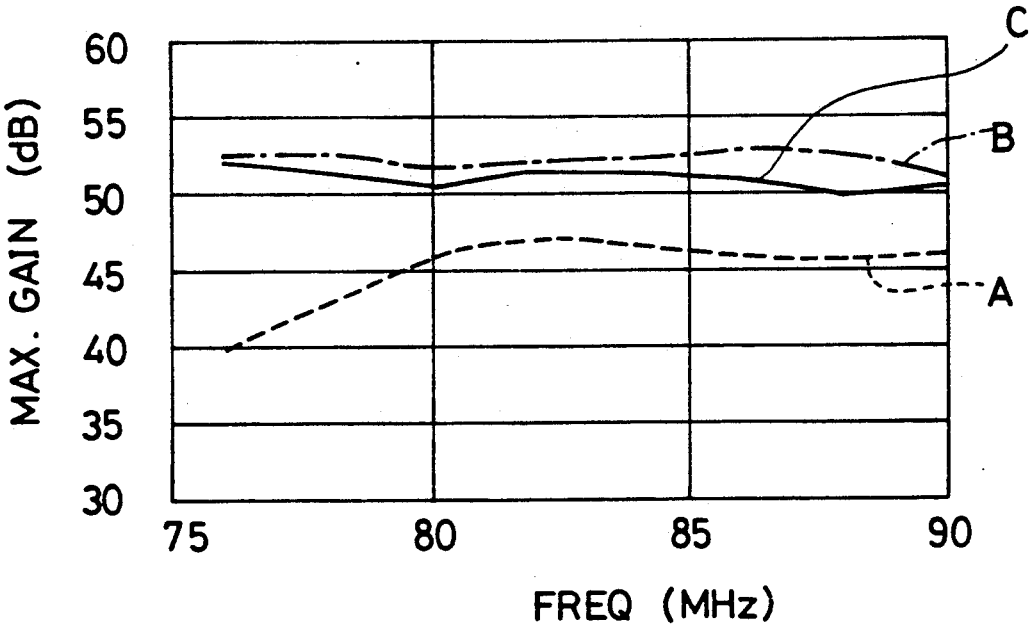
FIG. 7 is a graphic presentation of an FM maximum reception sensitivity of the embodiment of FIG. 3 together with that of a pillar antenna and that of an antenna arrangement without the antenna elements 23-25 in FIG. 3.
Figure 8:
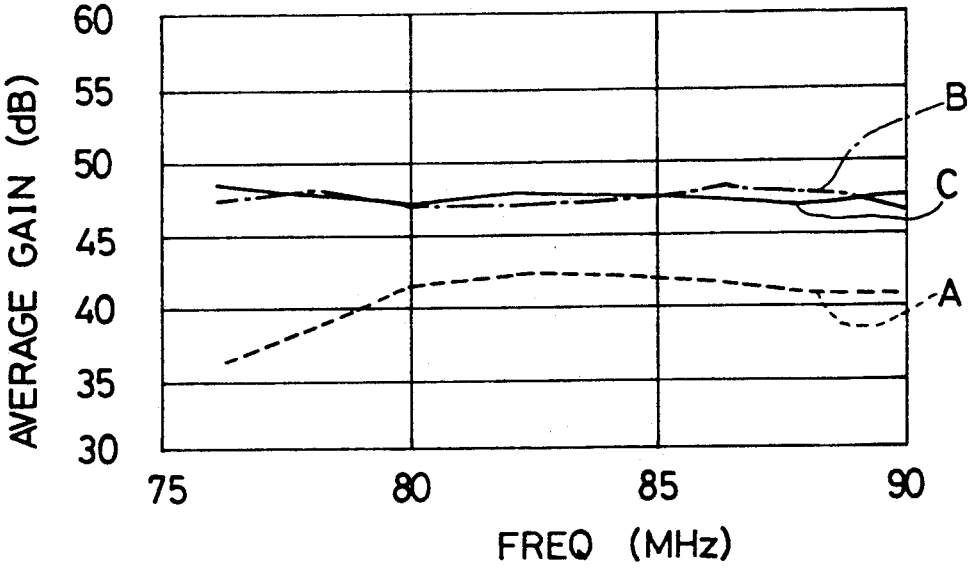
FIG. 8 is a graphic presentation of FM average reception sensitivity for the same antenna arrangements as those of FIG. 7.
Figure 9:
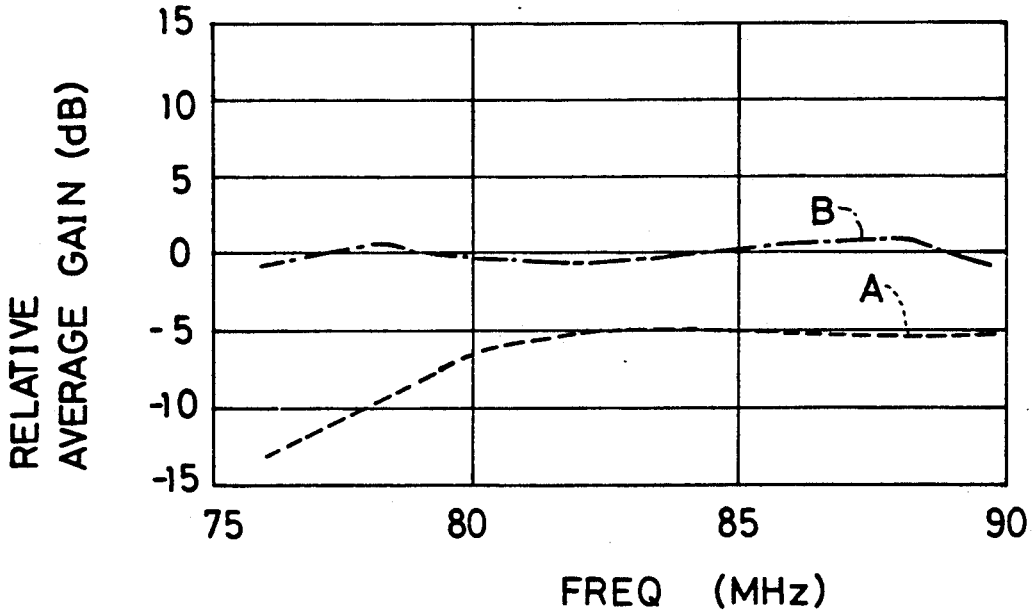
FIG. 9 is a graphic presentation of the FM relative reception sensitivity for the embodiment of FIG. 3 and for the arrangement without the antenna elements 23-25 in FIG. 3, as normalized by the sensitivity of the pillar antenna.

In FIG. 7 to 9 showing reception sensitivity to an FM band of 75 to 90 MHz, each curve A was obtained when the antenna elements 23 to 25 were omitted from the arrangement of FIG. 3, each curve B was obtained with the antenna elements 23 to 25, and each curve C was obtained with a pillar or rod antenna of 920 millimeters. FIG. 7 shows maximum reception sensitivity while FIG. 8 shows averaged reception sensitivity, and FIG. 9 shows a relative reception sensitivity with and without antenna elements 23 to 25 in relation to zero decibel reference of the pillar antenna.

As noted from FIGS. 7 to 9, the addition of the antenna elements 23 to 25 makes a significant improvement of reception sensitivity for FM band over the arrangement without the antenna elements 23 to 25. The reception sensitivity with the antenna elements 23 to 25 are noted as good as that obtained from pillar antennas.

Figure 10:
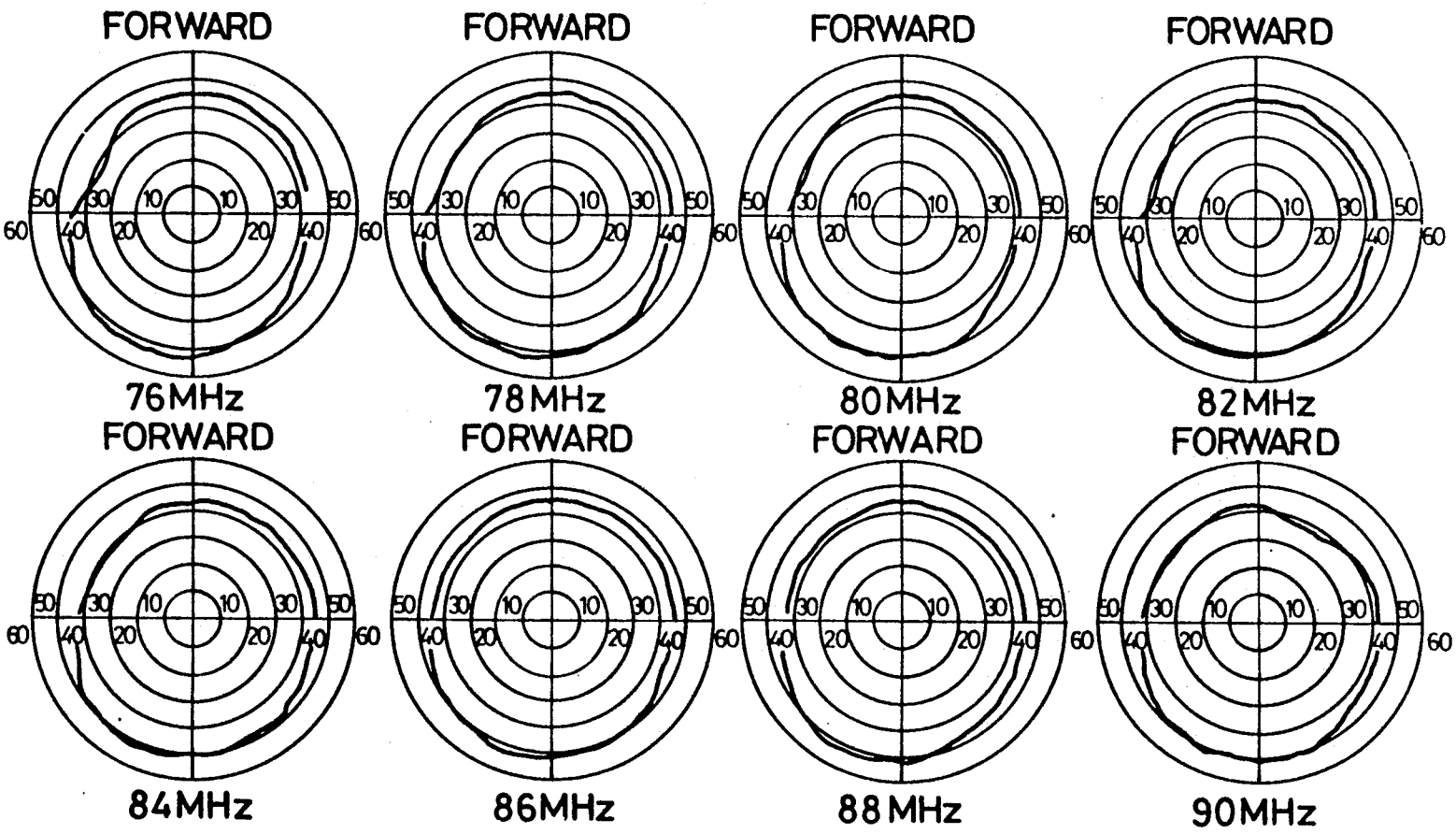
FIG. 10 is a graphic presentation of antenna directivity of the embodiment of FIG. 3 for radio frequencies in an FM band with a horizontal polarity.

In addition, the antenna elements 23–25 can serve to improve antenna directivity. FIG. 10 shows antenna directivity measured with the arrangement of FIG. 3 with the antenna elements 23–25, using horizontally polarized radio waves at 76, 78, 80, 82, 84, 86, 88, 90 MHz, respectively. As noted, a substantially circular or omnidirectional antenna directivity was obtained i.e., the antenna gain was substantially constant irrespective of the direction of the radio wave in relation to the antenna.

In some circumstances, such as in Japanese local radio stations and in U.S.A, vertically polarized radio waves are used in place of horizontally polarized radio waves. It has been formed that the antenna arrangement of FIG. 3 is also effective to such vertically polarized radio systems.

Figure 11:
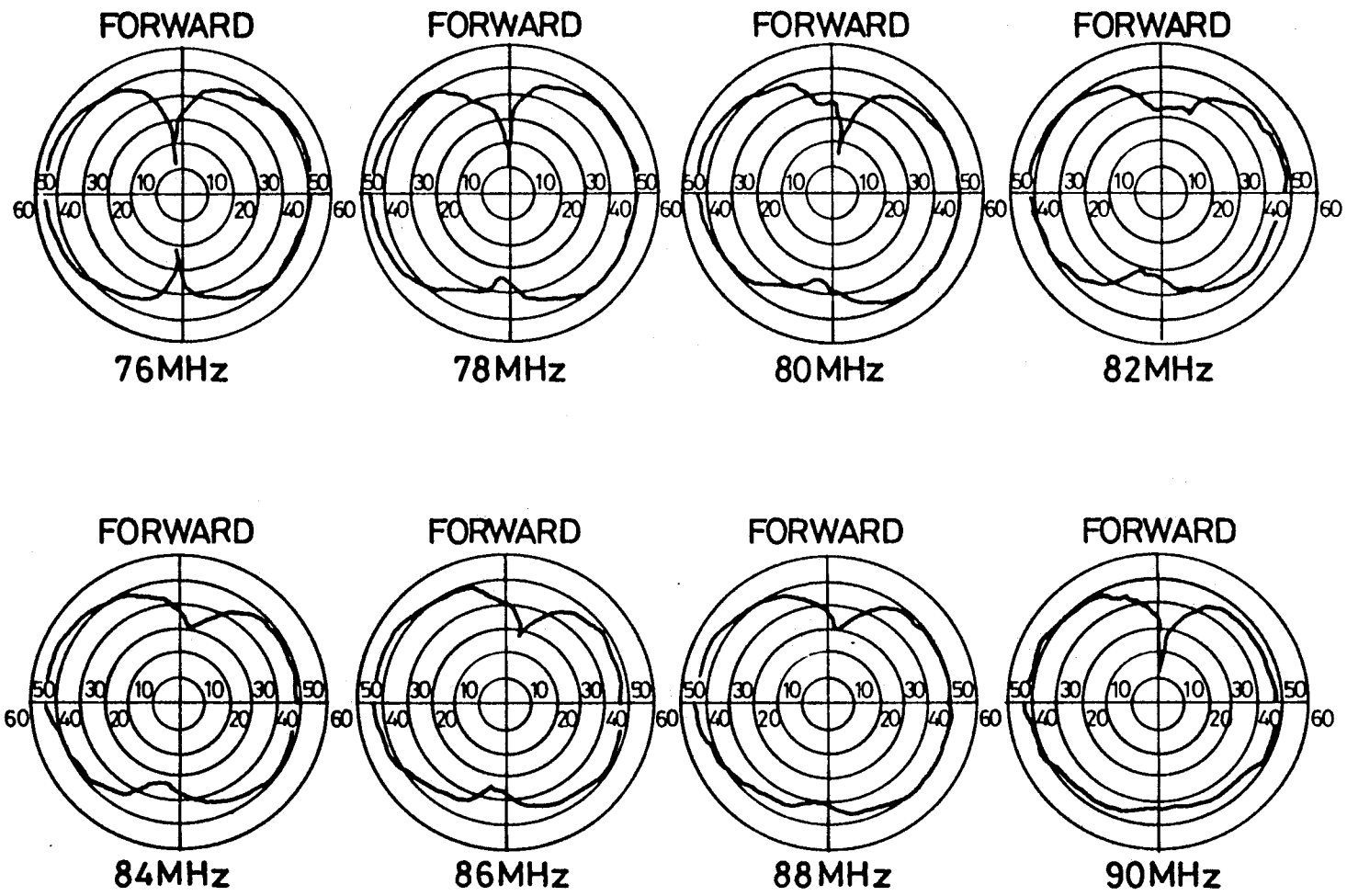
FIG. 11 is a graphic presentation of antenna directivity of the embodiment of FIG. 3 for radio frequencies in an FM band with a vertical polarity.

FIG. 11 shows antenna directivity of the arrangement of FIG. 3 measured with vertically polarized radio waves in an FM band. As noted, the resultant antenna directivity has indicated an $\propto$ curve with the minimum antenna gain when the radio wave is applied in forward and backward direction in relation to the antenna. This is in contrast to the prior art glass antenna FM antenna which provide antenna directivity of an 8 shape with the minimum antenna gain when the radio wave is applied in a direction horizontally and laterally crossing the antenna. Therefore, a combination of the prior art antenna with the arrangement of FIG. 3 will constitute a most useful diversity antenna system with optimized antenna directivity for vertically polarized radio waves.

Figure 12:
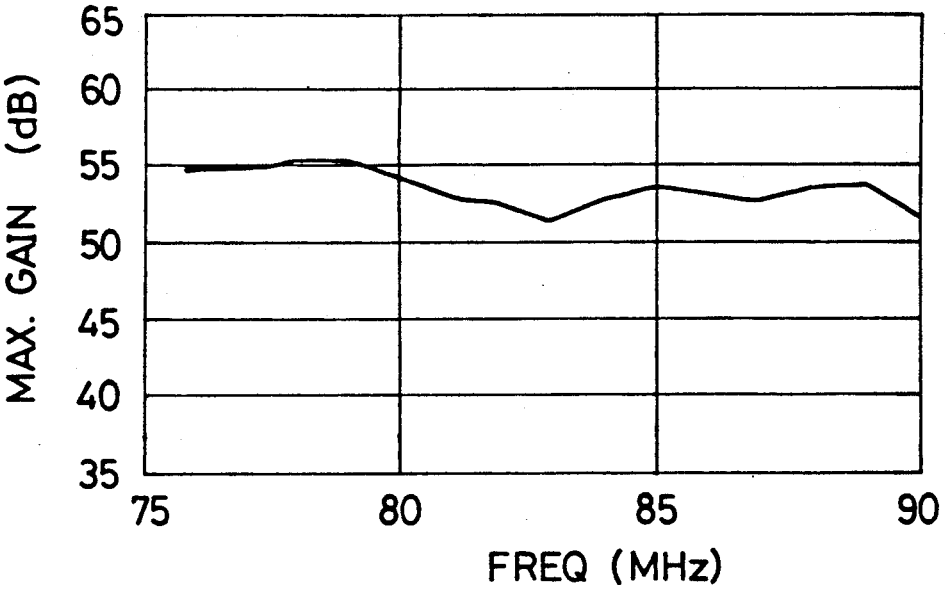
FIG. 12 is a graphic presentation of FM maximum reception consisting of the embodiment of FIG. 3 as measured with vertically polarized radio waves in an FM band.
Figure 13:
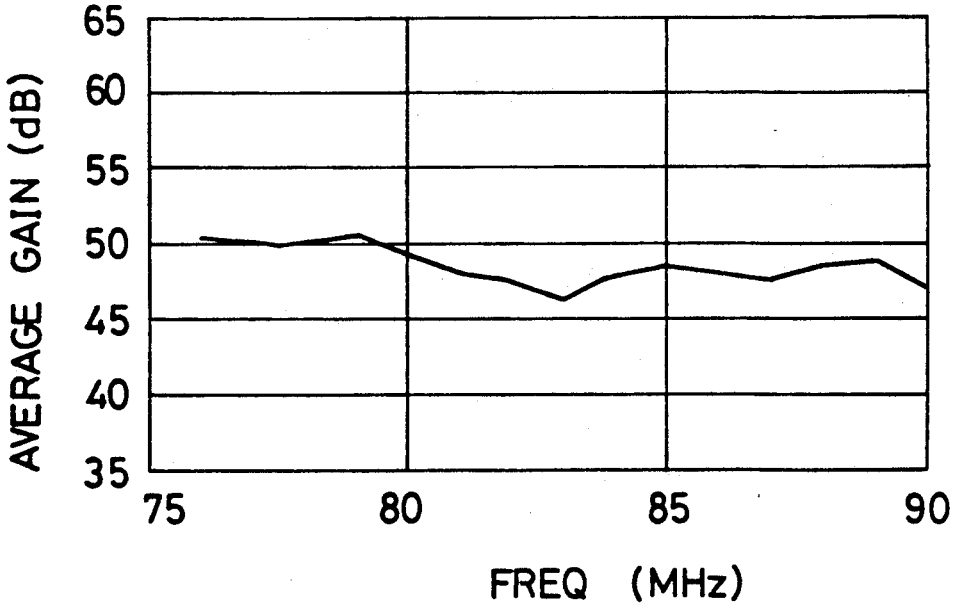
FIG. 13 is a graphic presentation of the FM average reception sensitivity of the embodiment of FIG. 3 as measured with vertically polarized radio waves in an FM band.

FIG. 12 shows maximum antenna reception sensitivity and FIG. 13 shows average antenna reception sensitivity, both measured with the arrangement of FIG. 3 using vertically polarized radio waves in an FM band of 75 to 90 MHz. The resultant sensitivity is as good as that obtained with horizontally polarized radio waves (see FIGS. 7 and 8}. Therefore, the addition of the antenna elements 23 to 25 serves to improve radio reception sensitivity to an FM band of vertically polarized radio signals as well.

Figure 14:
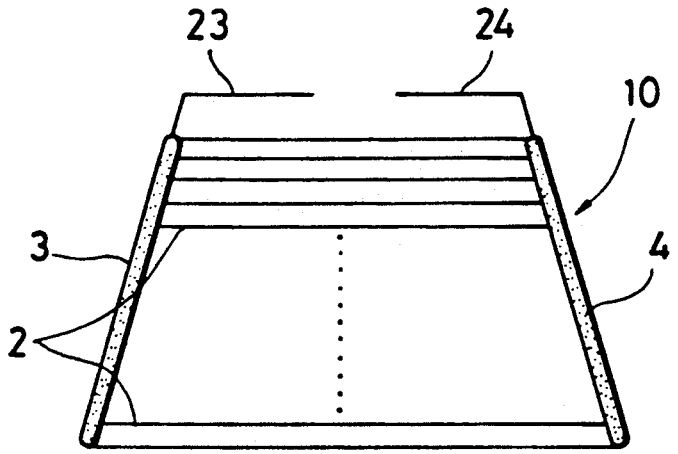
FIG. 14 shows a glass window antenna in which the auxiliary antenna element 25 in FIG. 3 is omitted.
Figure 15:
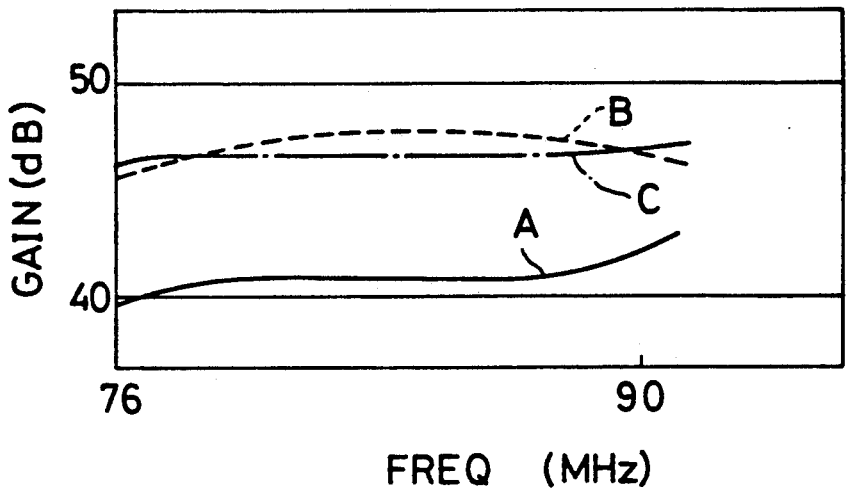
FIG. 15 is a graphic presentation of the FM reception sensitivity for the embodiment of FIG. 3 as compared with the sensitivity of the arrangement without the auxiliary antenna element 25 in FIG. 3 and the sensitivity of the arrangement without any of the antenna elements 23-25 in FIG. 3.

In FIG. 14, there is shown a glass window antenna in which the auxiliary coupling antenna element 25 in FIG. 3 is omitted. Without the element 25, antenna reception sensitivity to an FM band was somewhat concaved as indicated by a curve B in FIG. 15 in which the curve C was measured with the element 25 and the curve A was obtained without any of the antenna elements 23 to 25. As noted, the addition of the auxiliary antenna element 25 disposed between the antenna elements 23 and 24 has flattened the radio reception sensitivity over the substantially entire range of an FM band.

FIGS. 16 to 19 show modifications of the embodiments of FIG. 3 in respect of the location and connection of the capacitor 27.

Figure 16:
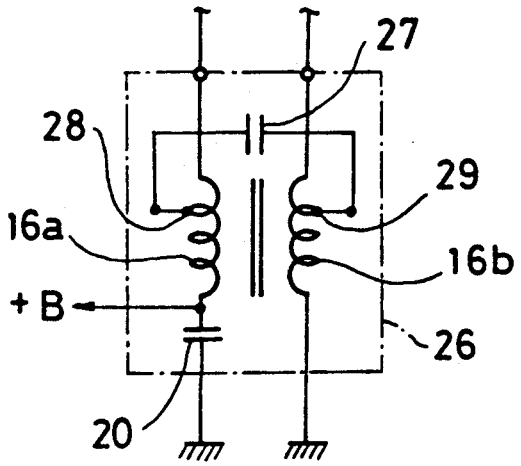
FIG. 16 shows a modified location of the connection with the capacitor 27 in the choke coil assembly.

In FIG. 16, the capacitor is connected across taps 28 and 29 provided in the respective choke coils 16*a* and 16*b*.

Figure 17:
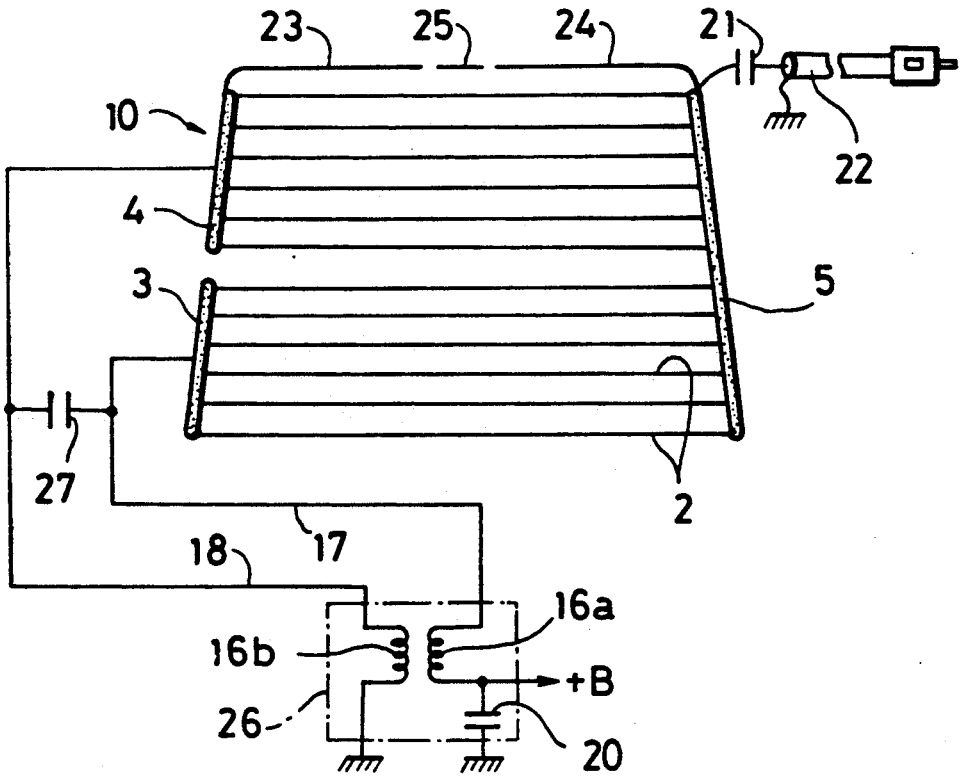
FIG. 17 shows a glass window antenna arrangement in which the capacitor 27 is connected at a modified location of the power supply lines.

In FIG. 17, the capacitor 27 is connected across the heating power supply lines 17 and 18 at a position between the choke coil assembly 26 to the heating conductor 10. An appropriate choice of the location of the power supply lines 17 and 18 where the capacitor 27 is connected thereacross may optimize the antenna characteristics.

Figure 18:
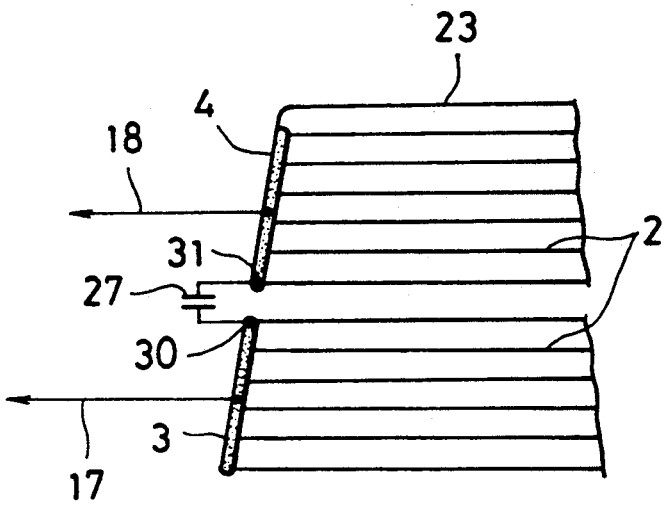
FIG. 18 shows a modified connection of the capacitor 27 as applied to a glass window antenna with a one-sided heating power feeding arrangement.
Figure 19:
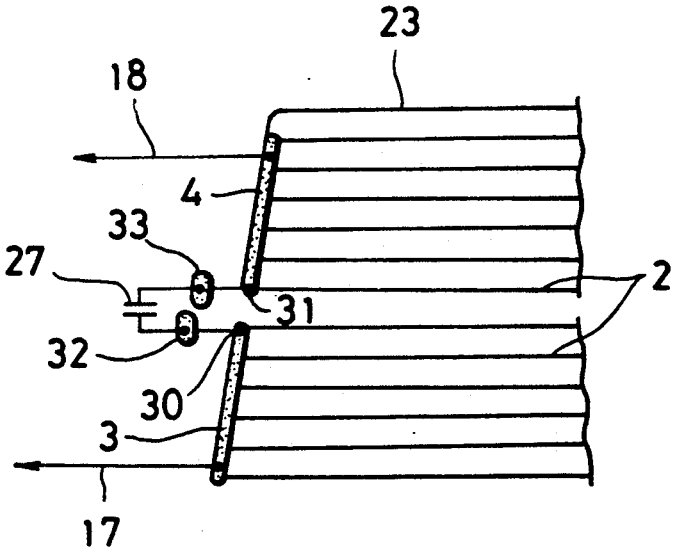
FIG. 19 shows a modified connection of the capacitor 27 as applied to a glass window antenna similar to that shown in FIG. 18.

In the case of FIG. 18 in which a heating current is supplied to only one side of the rear window 1, here, power supply buses 3 and 4, the space between the power supply buses 3 and 4 is only a small distance. Thus, the capacitor 27 may readily be connected between the adjacent ends 30 and 31 of the power supply buses 3 and 4. Also, as shown in FIG. 19, auxiliary terminals or connecting pads 32 and 33 may be provided near the ends 30 and 31 of the buses 3 and 4 to connect the capacitor 27 between the pads 32 and 33.

FIG. 20A-20G, 21 and 22 show other modifications of the embodiment of FIG. 3 in respect of the antenna elements 23-25.

Figure 20C:
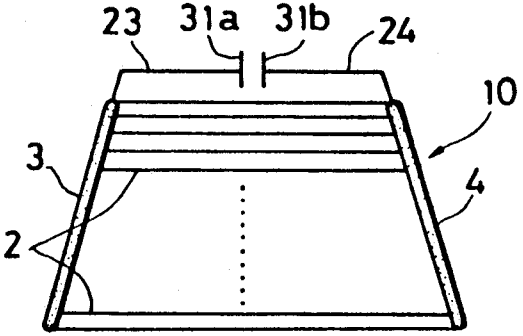
FIGS. 20A-20G show glass window antennas modified in respect of the antenna elements 23-25 in FIG. 3.
Figure 20B:
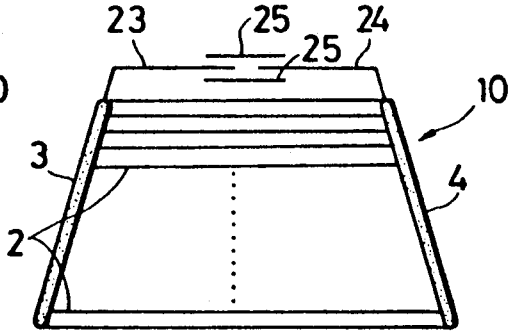
Figure 20A:
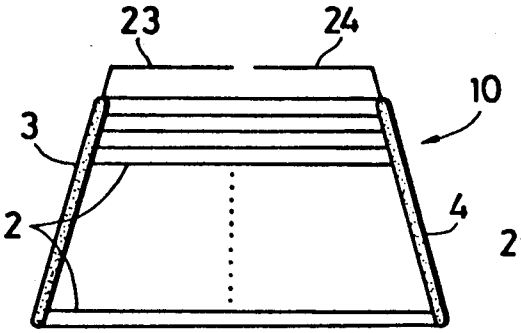

In FIG. 20A, the second antenna element 25 is omitted so that the antenna elements 23 and 24 directly faces each other.

In FIG. 20B, a pair of antenna elements 25 is employed which vertically spaced from each other and sandwiches ends of the antenna elements 23 and 24 in the space.

In FIG. 20C, instead of the antenna element 25, vertical wires 31*a* and 31*b* are formed at ends of the antenna elements 23 and 24 to couple them in a capacitive manner.

Figure 20G:
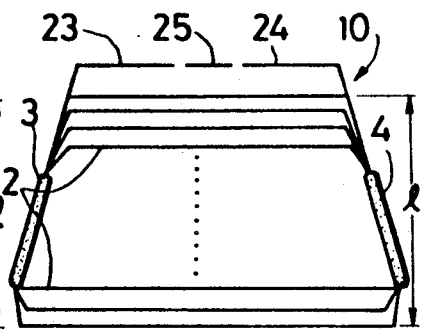
Figure 20F:
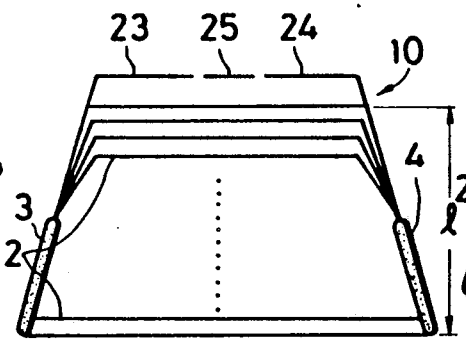
Figure 20E:
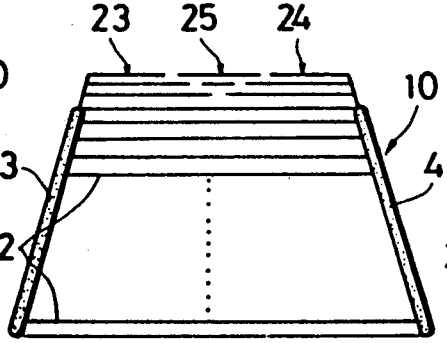
Figure 20D:
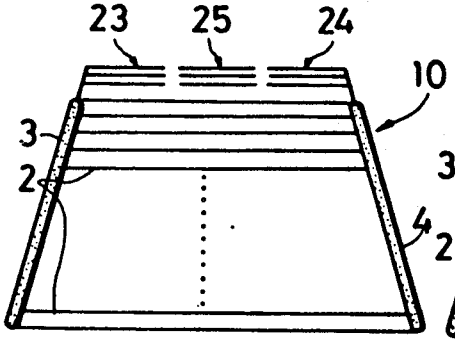

In FIG. 20D, a plurality of parallel wires 23-25 are employed to increase the associated capacitance so that the arrangement of FIG. 20D will be useful for a broad band antenna.

In FIG. 20E, a plurality of parallel and staggered or offset wires 23-25 are employed to improve the frequency characteristic.

Further, each antenna element 25 in FIGS. 20D and 20E may be omitted.

In FIGS. 20F and 20G, in order to save conductive paste materials for the power supply buses 3 and 4, the length of each power supply bus 3, 4 is made short and some heating wires connected to the buses 3 and 4 extend obliquely at part hereof as shown. In FIGS. 20F and 20G, an equivalent length of the buses 3 and 4 is indicated by l.

Figure 21:
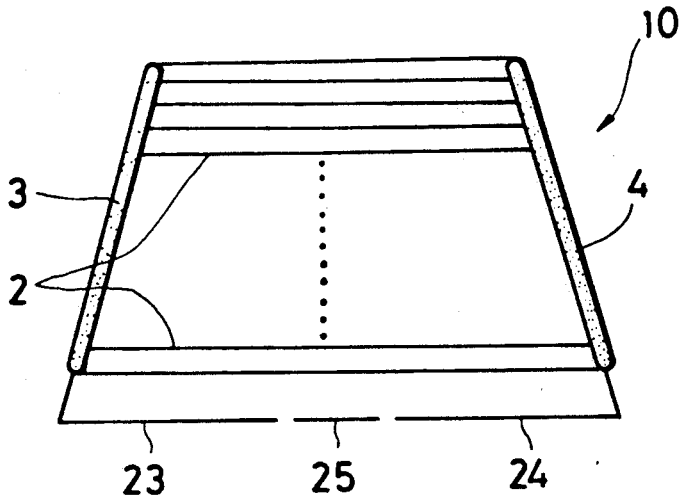
FIG. 21 shows another glass window antenna modified with respect to the antenna elements 23-25 in FIG. 3.
Figure 22:
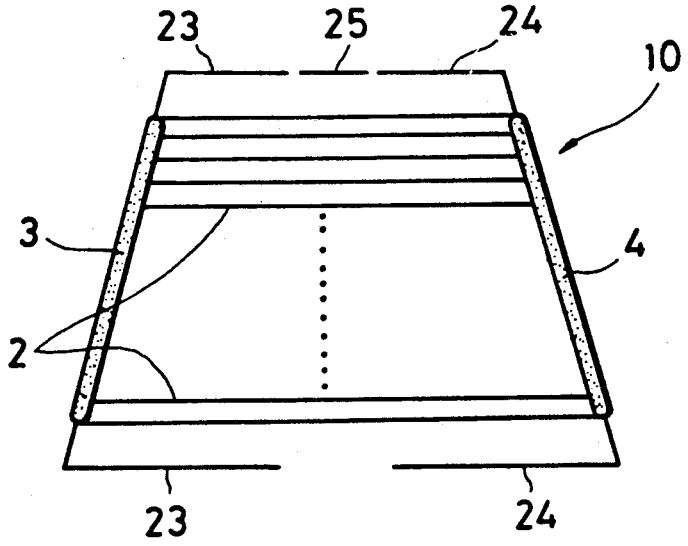
FIG. 22 shows still another glass window antenna modified with respect to the antenna elements 23-25 in FIG. 3.

In FIG. 21, the antenna elements 23-25 are formed on the bottom margin of the window 1 while in FIG. 22, a first set of antenna elements 23-25 is formed on the top margin of the window 1 and a second set of antenna elements 23 and 24 is formed on the bottom margin of the window.

This concludes the detailed description of the invention. However, many other modifications, variations and alternations will be obvious to one of ordinary skill in the art without deviating from the scope of the invention which should be solely limited by the appended claims.

What is claimed is;

1. A glass window antenna for use in a motor vehicle comprising:

a heating conductor formed on a glass window; and a plurality of antenna elements arranged on said glass window comprising a first antenna element, a second antenna element and a third antenna element, said first antenna element and said second antenna element being disposed in a substantially symmetrical mirror-image relationship with respect to a vertical center axis of said heating conductor, said first antenna element having one end connected to one end of said heating conductor, a corresponding part of said second antenna element having one end connected to the other end of said heating conductor, said third antenna element being axially aligned with and disposed between said first and said second antenna elements on said glass window, said third antenna element further being spaced from said first and second antenna elements so as to be electrically disconnected therefrom.

2. The glass window antenna of claim 1 further comprising a feeder connected to said heating conductor for gathering and carrying signals received in said heating conductor and said antenna elements.

3. The glass window antenna of claim 2 wherein said feeder carries signals covering both AM and FM broadcasting bands available for radio receiving circuitry.

4. The glass window antenna of claim 1 further comprising coupling means for capacitively coupling said antenna elements with each other.

5. The glass window antenna of claim 1 wherein said heating conductor comprises a plurality of parallel heating wires horizontally arranged on said glass window incorporated in said motor vehicle, and first and second bus bars formed on said glass window wherein said first bus bar is connected to said plurality of parallel heating wires at their first ends and connected to one of a pair of power supply lines, and said second bus bar is connected to said plurality of parallel heating wires at their second ends and connected to the other of said pair of power supply lines.

6. The glass window antenna of claim 1 wherein said heating conductor comprises first and second pluralities of parallel heating wires horizontally arranged on said glass window incorporated in said motor vehicle, and first, second, and third bus bars formed on said glass window wherein said first bus bar is connected to said first plurality of parallel heating wires at their first ends and connected to one of a pair of power supply lines, said second bus bar is connected to said second plurality of parallel heating wires at their first ends and connected to the other of said pair of power supply lines, and said third bus bar is connected to both said first and second pluralities of parallel heating wires at their second ends.

7. The glass window antenna of claim 1 further comprising choke coils with a pair of power supply lines connecting said choke coils to said heating conductor to supply a heating current to said heating conductor and a capacitor connected across said power supply lines.

8. The glass window antenna of claim 7 wherein said capacitor has a capacitance which is between 5 pico farads and 0.1 micro farads.

9. The glass window antenna of claim 7 wherein said capacitor has a capacitance which is between 30 and 200 pico farads.

10. A glass window antenna for use in a motor vehicle comprising:

a heating conductor formed on a glass window; and a plurality of antenna elements arranged on said glass window comprising a first antenna element, a second antenna element and a third antenna element, said first and second antenna elements being disposed in a substantially symmetrical mirror-image relationship with respect to an axis of said heating conductor, said first antenna element having one end connected to one end of said heating conductor, a corresponding part of said second antenna element having one end connected to the other end of said heating conductor, said third antenna element being disposed between said first and second antenna elements so as to be in axial alignment with said first and second antenna elements, said third antenna element further being spaced from said first and second antenna elements so as to be electrically disconnected therefrom.

11. The glass window antenna of claim 10 further comprising a feeder connected to said heating conductor for gathering and carrying signals received in said heating conductor and said three antenna elements.

12. The glass window antenna of claim 11 wherein said feeder carries signals covering both AM and FM broadcasting bands available for radio receiving circuitry.

13. The glass window antenna of claim 10 further comprising coupling means for capacitively coupling said antenna elements with each other.

14. The glass window antenna of claim 10 wherein said heating conductor comprises a plurality of parallel heating wires horizontally arranged on said glass window incorporated n said motor vehicle, and first and second bus bars formed on said glass window wherein said first bus bar is connected to said plurality of parallel heating wires at their first ends and connected to one of a pair of power supply lines, and said second bus bar is connected to said plurality of parallel heating wires at their second ends and connected to the other of said pair of power supply lines.

15. The glass window antenna of claim 10 wherein said heating conductor comprises first and second pluralities of parallel heating wires horizontally arranged on said glass window incorporated in said motor vehicle, and first, second, and third bus bars formed on said glass window wherein said first bus bar is connected to said first plurality of parallel heating wires at their first ends and connected to one of a pair of power supply lines, said second bus bar is connected to said second plurality of parallel heating wires at their first ends and connected to the other of said pair of power supply lines, and said third bus bar is connected to both said first and second pluralities of parallel heating wires at their second ends.

16. The glass window antenna of claim 10 wherein a pair of power supply lines connects opposite windings of a choke coil to said heating conductor to supply a heating current to said heating conductor, and wherein a capacitor is connected across said power supply lines.

17. The glass window antenna of claim 16 wherein said capacitor has a capacitance between 5 pico farads and 0.1 micro farads.

18. The glass window antenna of claim 16 wherein said capacitor has a capacitance between 30 and 200 pico farads.

* * * * *